US005406292A

United States Patent [19]

Schnetzer et al.

[11] Patent Number: 5,406,292

[45] Date of Patent: Apr. 11, 1995

[54] CROSSED-SLOT ANTENNA HAVING INFINITE BALUN FEED MEANS

[75] Inventors: Michel W. Schnetzer, Longmont; Dean A. Paschen, Lafayette, both of Colo.

[73] Assignee: Ball Corporation, Muncie, Ind.

[21] Appl. No.: 74,217

[22] Filed: Jun. 9, 1993

[51] Int. Cl.[6] ..... H01Q 1/38

[52] U.S. Cl. ..... 343/700 MS; 343/830; 343/872

[58] Field of Search ..... 343/767, 770, 700 MS File, 343/795, 797, 830, 872, 846, 853; H01Q 1/38, 13/10

[56] References Cited

U.S. PATENT DOCUMENTS

| | | | |
|---|---|---|---|
| 2,832,955 | 4/1958 | Jasik | 343/776 |
| 3,031,665 | 4/1962 | Robert-Pierre Marie | 343/770 |
| 3,811,127 | 5/1974 | Griffee et al. | 343/705 |
| 3,938,161 | 2/1976 | Sanford | 343/829 |
| 4,070,676 | 1/1978 | Sanford | 343/700 |
| 4,180,817 | 12/1979 | Sanford | 343/700 |
| 4,226,228 | 5/1980 | Perrotti | 343/771 |
| 4,242,685 | 12/1980 | Sanford | 343/770 |
| 4,443,802 | 4/1984 | Mayes | 343/729 |
| 4,547,779 | 10/1985 | Sanford et al. | 343/700 |
| 4,672,386 | 6/1987 | Wood | 343/770 |
| 4,710,775 | 12/1987 | Coe | 343/727 |
| 4,783,661 | 11/1988 | Smith | 343/700 MS |
| 4,803,494 | 2/1989 | Norris et al. | 343/770 |
| 4,973,972 | 11/1990 | Huang | 343/700 MS |
| 5,280,297 | 1/1994 | Profera, Jr. | 343/700 MS |

FOREIGN PATENT DOCUMENTS 1646014 4/1991 U.S.S.R. .

OTHER PUBLICATIONS

A Shallow Ridged-Cavity Crossed-Slot Antenna for the 240- to 400-MHz Frequency Range, H. E. King and J. L. Wong, IEEE Transactions on Antennas and Propagation, Sep. 1976.

A Shallow-Cavity UHF Crossed-Slot Antenna, C. A. Lindberg, Apr. 1969.

Recent Developments in the Design of Conformal Microstrip Phased Arrays, G. G. Sanford and L. Klein (date is not available).

Slot Antennas, Judd Blass, Chapter 8, pp. 8-1-8-26, Antenna Engineering Handbook, 1951.

*Primary Examiner*—Donald Hajec
*Assistant Examiner*—Tan Ho
*Attorney, Agent, or Firm*—Gilbert E. Alberding

[57] ABSTRACT

A crossed-slot antenna having a reduced number of feed components to achieve circular polarization. The present invention provides a crossed-slot antenna capable of transceiving circularly polarized radiation and having a feed network comprising a ninety degree hybrid and at least one infinite balun. In one embodiment, a transmission line is used to feed a pair of antenna patch elements, one of which acts as a local ground plane for the microstrip line, thereby defining an infinite balun. The transmission line may comprise a microstrip line, the inner conductor of a coaxial cable, or a coplanar waveguide.

22 Claims, 5 Drawing Sheets

CROSSED-SLOT ANTENNA HAVING INFINITE BALUN FEED MEANS

FIELD OF THE INVENTION

The present invention relates generally to crossed-slot antennas having feed means for producing circular polarization.

BACKGROUND OF THE INVENTION

Four important considerations in the design of an antenna are bandwidth, beamwidth, profile height, and ability to transceive radiation of specified polarization(s). The requirements of an antenna in these four categories depend on the application for which the antenna is designed. In a number of applications, including Global Positioning System (GPS) arrangements, UHF satellite communications, and certain military uses, a relatively large bandwidth, wide beamwidth, low profile, and ability to transceive circularly polarized radiation are advantageous. For example, if an antenna is to be mounted on a high performance vehicle and used for UHF satellite communications, it should have a low profile for aerodynamic efficiency, and it must have the bandwidth, beamwidth, and polarization characteristics necessary to communicate with UHF satellites. Crossed-slot antennas have been used in such situations because of their generally low profile and ability to be driven in phase quadrature to achieve circular polarization.

Typically, crossed-slot antennas comprise a rectangular cavity, dimensioned to be resonant at the frequency of operation. Crossed slots are cut into one broadwall of the cavity to form the radiation means. The cavity is typically excited via probes inserted into the cavity or by transmission lines place across the slots.

One type of crossed-slot antenna is shown in FIG. 1. Each of the four planar patches of metallization is short circuited on a different edge of the ground plane. Thus, radiating edges of the four patches form crossed slots across the antenna as illustrated in FIG. 1. Also, the radiating edges of diagonally opposed patches are collinear and define two nearly continuous and crossed apertures in conjunction with the ground plane below. In certain applications, it is desirable to provide balanced transmission of signals (equal power and 180 degrees out of phase) by the diagonally opposed patches so as to maintain symmetry in the radiation pattern of the antenna. However, this has normally required an expensive and bulky network to feed the antenna patches.

For example, in order to use a crossed-slot antenna to transceive circularly polarized radiation, the patches must be fed in phase quadrature and, preferably, with equal power. In order to accomplish this, a full quadrature (0, 90, 180, 270 degrees) hybrid, such as the one illustrated in FIG. 1, is typically used to feed the patches. Hybrid networks of this type are normally large and complicated, and tend to be relatively narrowband. Either two 90 degree hybrids and a 180 degree hybrid, or a 90 degree hybrid and two 180 degree hybrids (as shown in FIG. 1) are generally used. The necessity of such complicated hybrid networks increases both the cost and the bulk of the antenna.

SUMMARY OF THE INVENTION

Accordingly, one object of the present invention is to provide a crossed-slot antenna having a reduced number of feed components.

Another object of the present invention is to provide a crossed-slot antenna capable of transceiving circularly polarized radiation with a reduced number of feed components.

Another object of the present invention is to provide an antenna having a low profile and broad bandwidth and beamwidth characteristics.

The present invention provides a crossed-slot antenna having first and second pairs of antenna patch elements disposed to define a crossed slot between their internal edges. A ground plane is disposed below the antenna patch elements to define a resonant cavity therebetween. At least the first pair of the antenna patch elements is fed via a transmission line which is disposed in opposing relation to and extending beyond an internal edge of one of the first pair of patches, thereby defining an "infinite" balun.

When a signal to be transmitted is fed to the transmission line, the signal propogates along the transmission line to the internal edge of one of the first pair of patches. When the signal reaches the internal edge of the one patch, another signal which is 180 degrees out of phase and equal in power to the original signal, is reflected back into the one patch, thereby exciting a resonant field. Also, the original signal continues to propogate along the transmission line until it reaches an internal edge of the other of the first pair of patches, where it excites another resonant field. The patches of the the first pair are thus fed with equal power and 180 degrees out of phase and thereby comprise a balanced transmission means. Consequently, when the first pair of patches is fed via an unbalanced transmission line, a balun is defined. Further, when the distance between the aforementioned internal edges of the first pair of patches is made small enough, an infinite balun is defined.

Normally, the present invention will also be provided with a second transmission line to feed the second pair of antenna patches. The second transmission line is disposed in opposing relation to and extending beyond an internal edge of a first patch of the second pair of patches to feed both patches of the second pair. The use of the second transmission line to feed the second pair of patches defines another infinite balun. Feeding the first and second pairs of patches with first and second transmission lines is particularly useful in enabling the antenna of the present invention to transceive circularly polarized radiation.

In order to transmit circularly polarized radiation, the antenna patches of the present invention may advantageously be fed in phase quadrature using a single ninety degree hybrid circuit. A signal to be transmitted via the antenna of the present invention is fed to the ninety degree hybrid circuit. The ninety degree hybrid circuit outputs first and second signals which are equal in power and ninety degrees out of phase with each other. The first and second signals are subsequently fed to the first and second transmission lines, respectively. As discussed above, the first patch in each pair of patches propagates a signal which is 180 degrees out of phase with the signal in its respective transmission line. Thus, when the patches in each pair are diagonally opposed, all four patches are fed in phase quadrature (i.e. each patch is 90 degrees out of phase with adjacent patches and 180 degrees out of phase with the patch diagonally opposed to it).

The transmission lines of the present invention may comprise microstrip lines which may be readily disposed on a dielectric substrate. The transmission lines may also comprise coaxial cables, coplanar waveguides or any other form of unbalanced transmission line.

When using microstrip lines as the transmission lines it may be desirable to dispose the first patch of the first pair and the second patch of the second pair of antenna patches on a first side of a dielectric substrate and the second patch of the first pair and the first patch of the second pair of antenna patches on an opposing side of the substrate. Each of the first and second microstrip lines may then be disposed on a different side of the dielectric substrate, separated from its local ground plane (the first patch in its respective pair of patches) and the other microstrip line by the dielectric. This allows for the patches in each of the first and second pairs to be diagonally opposed while permitting a simplified crossing of the microstrip lines without metallic contact between the two lines.

The antenna of the present invention may also be provided with a protective radome and foam members for structural support. The radome is provided to enclose and protect the antenna patch elements and feed network. Foam may be bonded into place between the antenna patch elements and the ground plane and between the radome and the antenna patch elements to increase the structural strength of the antenna. In addition, if the seal between the radome and the ground plane fails, the presence of the foam members decreases the volume of air enclosed by the radome and thereby reduces the negative effects of thermal cycling on the antenna.

Additional teachings of the present invention will become evident to one of ordinary skill in the art by the following detailed description and accompanying drawings.

DETAILED DESCRIPTION

Figure 1:
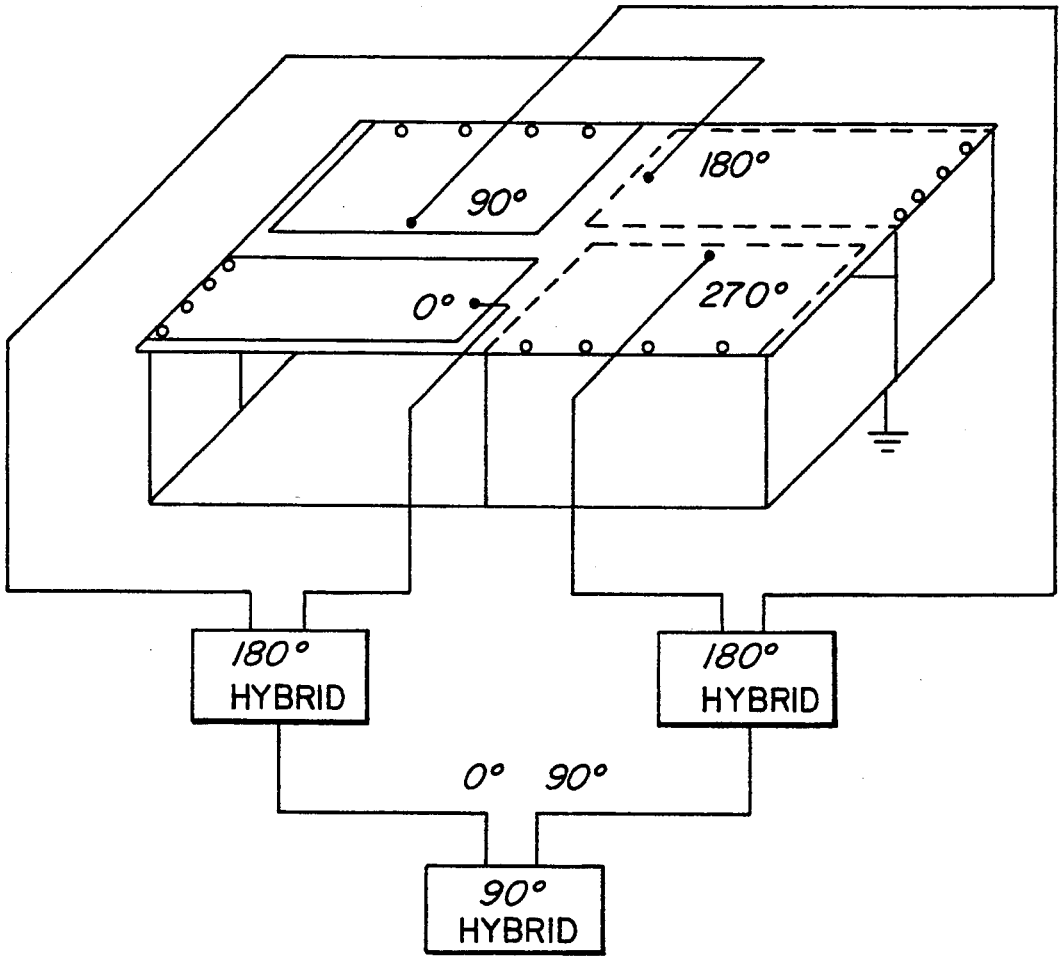
Fig. - 1 PRIOR ART
FIG. 1 is an illustration of a crossed-slot antenna according to the prior art.
Figure 2:
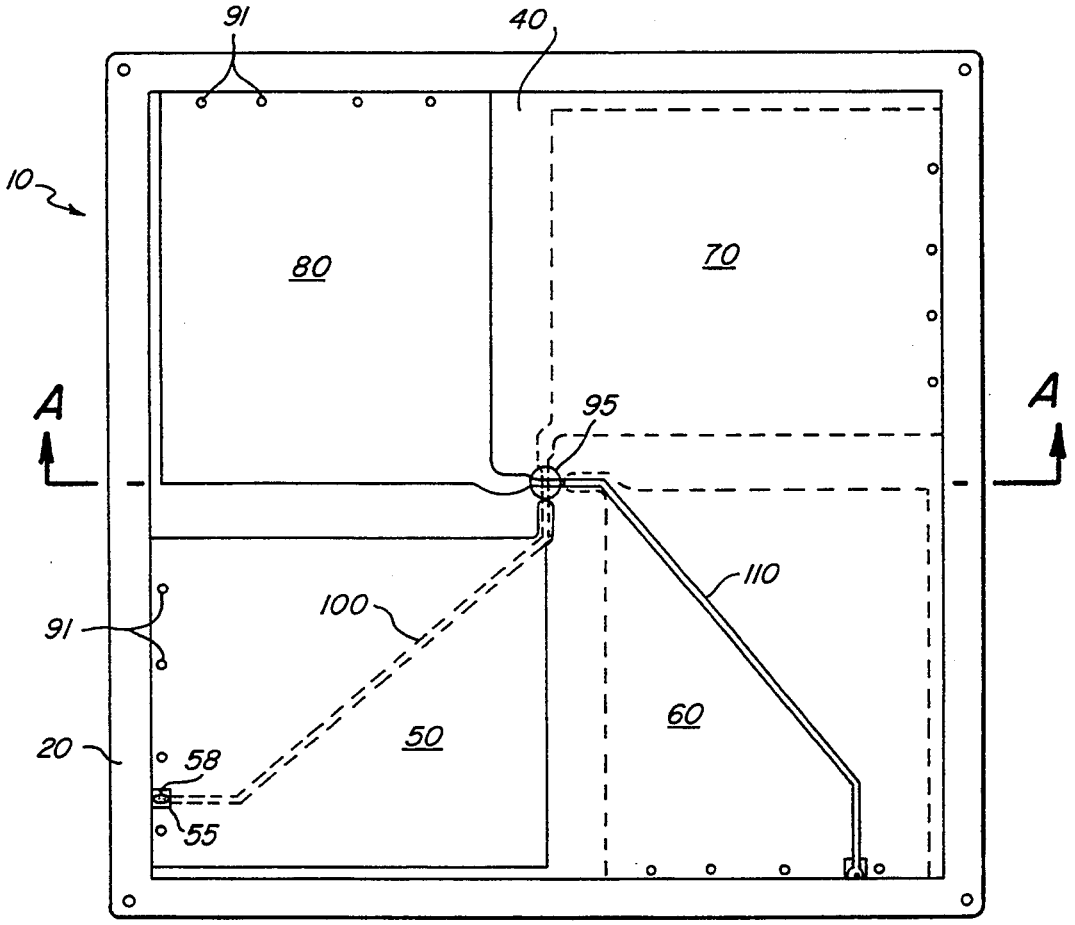
FIG. 2 is a top view of one embodiment of the present invention.
Figure 3:
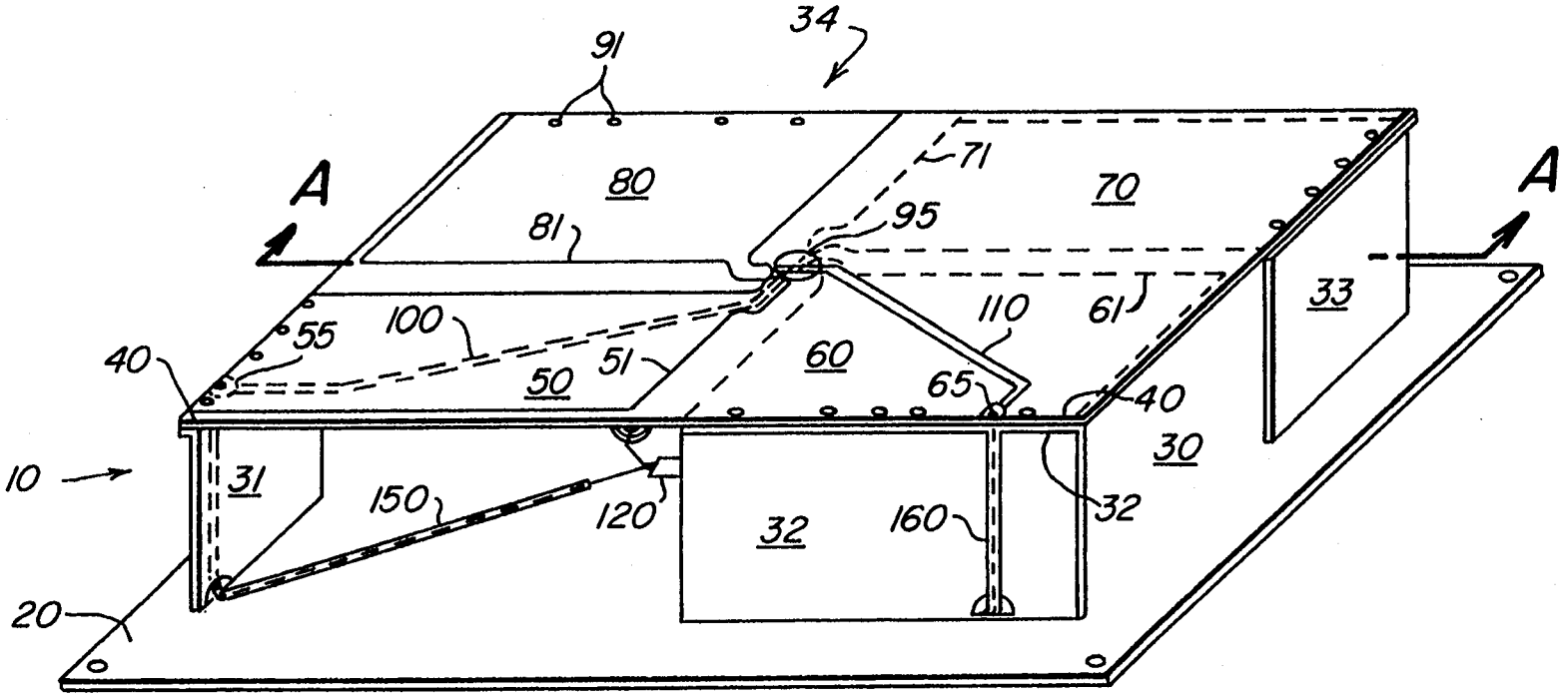
FIG. 3 is a perspective view of one embodiment of the present invention.
Figure 4:
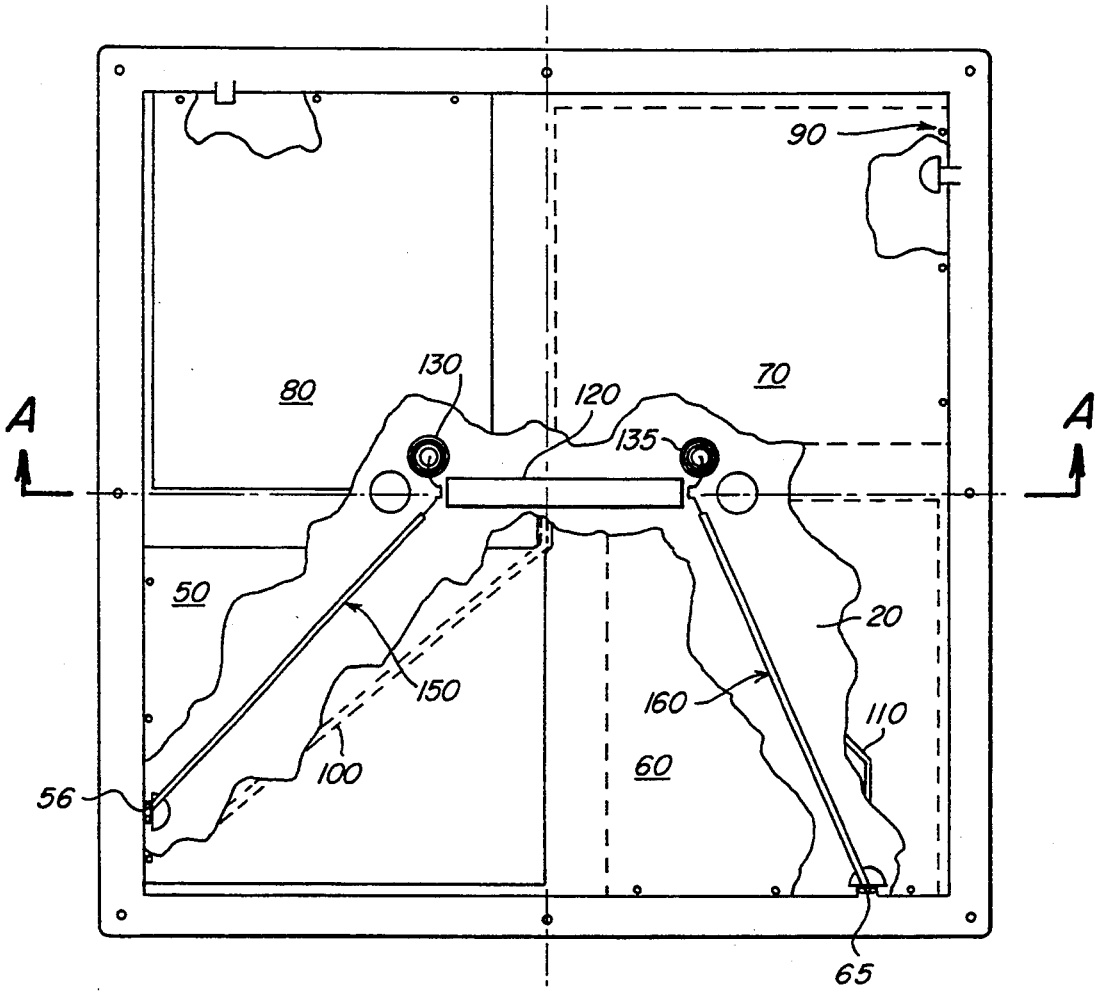
FIG. 4 is a top view of one embodiment of the antenna of the present invention with portions cut away to show a feed network.

FIGS. 2–4 illustrate one embodiment of the antenna of the present invention. Four planar and approximately equally sized patches of metallization 50,60,70,80 are disposed on a printed antenna board (PAB) 40. PAB 40 comprises a rigid member of dielectric material. The patches are disposed on PAB 40 such that diagonally opposed patches (i.e. patches 50 and 70 and patches 60 and 80) have collinear internal radiating edges (edges 51 and 71 and edges 61 and 81, respectively). Also, each patch is short circuited on an external edge, opposite the internal radiating edge. Preferably, the distance between the radiating edge and the short circuited edge is approximately one-quarter wavelength for each patch. In the embodiment illustrated, patches 60 and 70 are disposed on an opposite side of PAB 40 than patches 50 and 80.

PAB 40 is suspended above and parallel to a ground plane 20 by electrically conductive side walls 31–34. Side walls 31–34 are disposed on adjacent sides of antenna 10 to provide means for short circuiting the antenna patches of PAB 40 to ground plane 20. Side walls 31–34 may be connected to ground plane 20 via soldering or other attachment means which provides and electrical path between ground plane 20 and side walls 31–34.

In the embodiment illustrated, connector 130 is provided to connect an external coaxial cable (not shown) to antenna 10. The outer conductor of the external coaxial cable is attached to the underside of ground plane 20 to provide a ground signal for ground plane 20. The inner conductor of the external cable is threaded through a hole in ground plane 20 where it is soldered to connector 130.

Connector 130 includes a wire to connect the inner conductor of the external coaxial cable to hybrid circuit 120. Hybrid circuit 120 preferably comprises a microwave quadrature hybrid having an input, two outputs, and a terminal load. On its terminal end, hybrid network 120 is connected to connector 135 and to the inner conductor of coaxial cable 160. Connector 135 connects hybrid network 120 to a matched terminal load of 50 ohms (not shown) to avoid the reflection of signals in hybrid circuit 120 due to impedance mismatches in antenna 10.

Coaxial cables 150 and 160 are used to connect respective outputs of hybrid network 120 to microstrip feed lines 100 and 110 on PAB 40. The outer conductor of each cable 150 and 160 is placed in electrical contact with ground plane 20. Each cable 150 and 160 is threaded through a hole in respective side walls 31 and 32 and up the outer surface of respective side walls 31 and 32.

The inner conductor of each cable 150 and 160 is soldered to respective microstrip lines 100 and 110. Accordingly, the outer conductor and dielectric layer of each coaxial cable 150 and 160 is stripped so that the inner conductor of each cable may be connected to respective microstrip lines 100 and 110 at junctures 55 and 65. Microstrip line 100 extends along the underside of PAB 40 from juncture 56, across patch 50 (separated from patch 50 by PAB 40), to crossover point 95 where it connects to antenna patch 70. Similarly, microstrip line 110 extends from juncture 65, crossing above patch 60, to crossover point 95 where it connects to antenna patch 80.

The feed means for the present invention illustrated in FIGS. 2–4 is provided to achieve circular polarization, however it is recognized that the antenna of the present invention may also be provided with feed means to transceive dual-linearly polarized and linearly polarized radiation. For example, in order to achieve dual-linear polarization, ninety degree hybrid circuit 120 may be eliminated and both microstrip lines 100 and 110 may be fed with the original source signal via connector 130.

Figure 5:
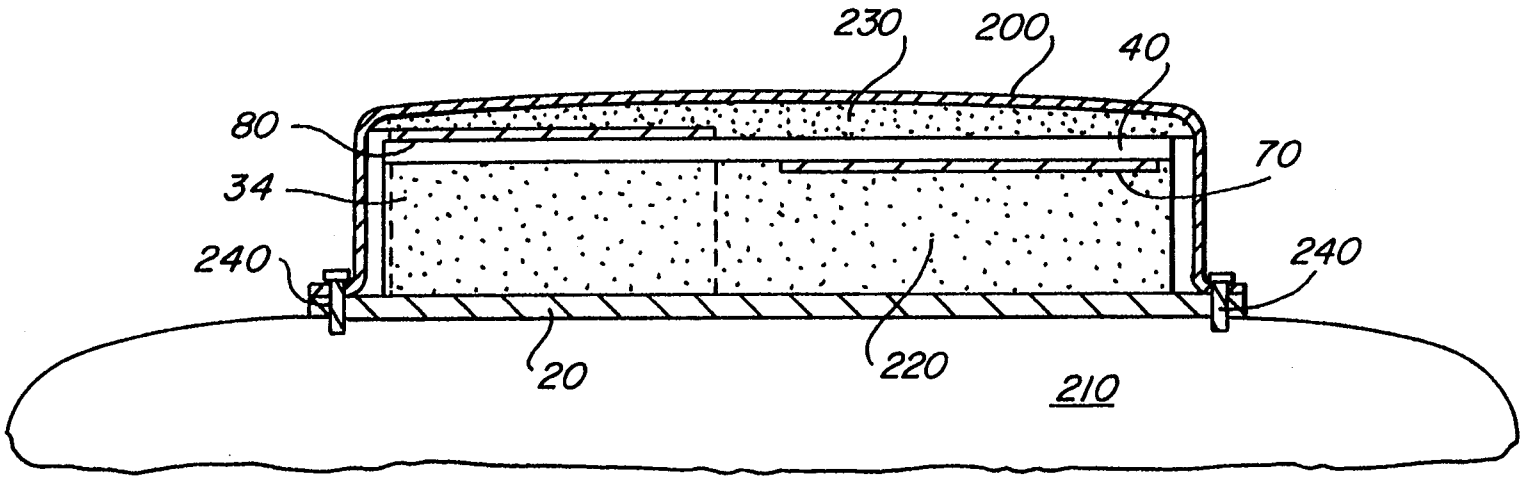
FIG. 5 is a cross-sectional side view of one embodiment of the antenna of the present invention including a radome and a support assembly.

FIG. 5 is a cross-sectional view along line A—A of the antenna illustrated in FIGS. 2–4 with a radome and support assembly added thereto. The feed elements of antenna 10 are not shown and the thicknesses of the antenna patches are exaggerated for clarity. A radome 200 is included to protect antenna 10 from corrosion and other environmental hazards. Radome 200 preferably comprises a single piece of molded plastic and is connected to ground plane 20 via screws 240. Also, an adhesive is used as a seal between radome 200 and ground plane 20. Note that the screws 240 may be used to connect the entire antenna 10 to a surface 210, such as the roof of a vehicle.

In addition, a support assembly comprising foam elements 220 and 230 is provided to increase the structural strength of antenna 10 and reduce the effects of thermal cycling on antenna 10 in case the seal between ground plane 20 and radome 200 fails. Foam members 220 and 230 may comprise polystyrene or polypropylene, and they preferably bond the layers of antenna 10 together to increase the overall structural strength of the antenna. Also, foam members 220 and 230 fill space which would otherwise be air-filled, thereby decreasing the negative effects of thermal cycling on antenna 10 should the seal between ground plane 20 and radome 200 fail. That is, if the seal fails, there is less air volume within radome 200 to expand and contract with changes in ambient temperature. Such expansion and contraction of air volume may draw in humid air which may lead to corrosion of the metallized portions of antenna 10 and subsequent operational difficulties.

The operation of the antenna of the present invention will now be described with reference to the embodiment illustrated in FIGS. 2–5. Note that, for clarity, the operation of antenna 10 will only be discussed with reference to the transmission of signals from antenna 10. However, it is recognized that, according to the Lorentz theory of reciprocity, any passive antenna (e.g. antenna 10) may also receive any signal which it is capable of transmitting.

In operation, a signal to be transmitted is fed via the inner conductor of an external coaxial cable (not shown) to connector 130. The outer conductor of the external coaxial cable provides a ground signal to ground plane 20. Connector 130 transmits the source signal from the inner conductor of the external cable to ninety degree hybrid circuit 120. Hybrid circuit 120 produces two output signals. The first output signal is identical to the original source signal and is transmitted to the inner conductor of coaxial cable 150. The second output signal of hybrid circuit 120 is identical to the first output signal except that it has been shifted in phase by ninety degrees. The second output signal is fed to the inner conductor of coaxial cable 160. The outer conductor of both cable 150 and 160 are short-circuited to the ground plane 20.

The signal carried by the inner conductor of coaxial cable 150 will be referred to as the original source signal as it not shifted in phase from the signal received at connector 30. The original source signal is carried by the inner conductor of coaxial cable 150 up the outer surface of side wall 31 to microstrip line 100 on the underside of PAB 40. When the original source signal is fed to microstrip line 100, it begins to propagate along the microstrip line towards crossover point 95. Importantly, patch 50, which is separated from microstrip line 100 by PAB 40, acts as a local ground plane for microstrip line 100. Thus, the original source signal creates an electric field in the dielectric layer (PAB 40) between microstrip line 100 and its local ground plane, patch 50. Also, a signal is propagated in patch 50 which is 180 degrees out of phase with the original source signal and identical in amplitude. This will be referred to as the 180 signal. Since patch 50 is much larger in area than microstrip line 100, though the total amount of current in each is equal, the current density is considerably less in patch 50. Consequently, microstrip line 100 and patch 50 comprise an unbalanced transmission line.

The two signals, the original source signal and the 180 signal, continue to propagate 180 degrees out of phase with each other until they reach crossover point 95. At crossover point 95 each of the antenna patches 50,60,70,80 ends and microstrip lines 100 and 110 (separated by PAB 40) cross. When the original source signal in microstrip line 100 reaches crossover point 95, it continues across in microstrip line 100 to excite patch 70. The transition from the relatively small microstrip line 100 to a much larger patch 70 forces the current carrying the original source signal to spread out rapidly. This discontinuity causes a resonant field to be excited in patch 70. The resonant field causes edge 71 to radiate and transmit the original source signal via the aperture between edge 71 and ground plane 20.

When the leading edge of the 180 signal in patch 50 reaches the crossover point 95, it is reflected back into patch 50, thereby creating another resonant field. This resonant field excites patch 50 and causes edge 51 to radiate, thereby transmitting the 180 signal via the aperture between edge 51 and ground plane 20.

Since the original source signal and the 180 signal are equal in amplitude and patches 50 and 70 are approximately equal in size, the current densities in the two patches are approximately equal, and the original source signal and the 180 signal are transmitted with approximately equal power. Thus, an unbalanced transmission line is used to feed a balanced antenna, thereby defining what may be referred to as a balun.

Note that patch 50 is extended near crossover point 95 to provide a ground plane for as much of microstrip line 100 as possible without interfering with patch 80. This minimizes the distance which the original source signal in microstrip line 100 must travel without a local ground plane. Patch 70 is similarly extended in order to maintain symmetry in the radiation pattern of antenna 10. Minimization of the crossover distance (the distance between patches 50 and 70) limits parasitic effects and maximizes the bandwidth in which antenna 10 may transceive signals. In the present invention, the distance between patches 50 and 70 may be made considerably smaller than a wavelength of radiation to be transceived by antenna 10. Consequently, the feed to antenna 10 may exhibit almost infinite broadband characteristics. Thus, the use of an unbalanced transmission line (microstrip 100 and patch 50) to feed a balanced antenna in the present invention may be referred to as an "infinite"-balun.

With regard to the other pair of antenna patches 60 and 80, the signal carried by the inner conductor of cable 160 will be referred to as the 90 signal as it is equal in amplitude and 90 degrees out of phase with the original source signal. The 90 signal is carried by the inner conductor of cable 160 to microstrip line 110 at juncture 65. The 90 signal propagates in microstrip line 110 towards crossover point 95. In this instance, microstrip line 110 uses patch 60, which is separated from microstrip line 110 by PAB 40, as a local ground plane. Thus, the 90 signal creates an electric field in the dielectric of PAB 40, and a signal is propagated in patch 60 which is equal in amplitude to the 90 signal (which, in turn, is equal in amplitude to the original source signal) and 180 degrees out of phase with the 90 signal. The signal which is propagated in patch 60 will be referred to as the 270 signal as it is 270 degrees out of phase with the original source signal. Since the total amount of current in microstrip line 110 and patch 60 is equal but the current density is considerably less in patch 60, microstrip line 110 and patch 60 comprise an unbalanced transmission line.

As previously described with respect to the original source signal and 180 signal, when the leading edges of the 90 signal and the 270 signal reach crossover point 95, they create resonant fields in patches 80 and 60, respectively. The 90 signal continues through microstrip line 110 across to patch 80 where it creates a resonant field and causes edge 81 to radiate and transmit the 90 signal via the aperture between edge 81 and ground plane 20. The 270 signal is reflected back into patch 60 where it also creates a resonant field and it causes edge 61 to radiate and transmit the 270 signal via the aperture between edge 61 and grounded plane 20. Since patches 60 and 80 are equal in size and current density, the 90 signal and the 270 signal will be transmitted with equal power. Thus, an unbalanced transmission line is again being used to feed a balanced antenna, and a second balun is thereby defined.

Note that patch 60 has also been extended near crossover point 95 to provide as complete a ground plane for microstrip line 110 as possible. Consequently, patch 80 has been extended to match patch 60 in size and maintain symmetry in the radiation pattern of antenna 10. Since the crossover distance between patch 60 and patch 80 may again be made much smaller than a wavelength of radiation to be transceived by antenna 10, the second balun discussed above may also be defined as an infinite balun.

It is important to note that while the antenna patches of the present invention are fed in phase quadrature, they are also physically clocked so that the radiating edges of diagonal patches are at 180 degrees to one another. The effect of this physical configuration is that the antenna excites two continuous slots across its entire width when transceiving radiation. Specifically, patch 50 and patch 70 are physically disposed at 180 degrees to one another, and they are fed with signals which are 180 degrees out of phase from one another. Thus, when edges 51 and 71 are excited, the entire aperture between ground plane 20 and edges 51 and 71 radiates in phase. Similarly, the aperture between ground plane 20 and edges 61 and 81 of patches 60 and 80 also radiates in phase. In addition, since there is a 90 degree difference in the signal feeds and a 90 degree difference in physical disposition, the aperture defined by patches 61 and 81 radiates 180 degrees out of phase with the aperture defined by edges 51 and 71. Consequently, antenna 10 is able to transceive circularly polarized radiation.

It is recognized that microstrip lines 100 and 110 may be replaced by other suitable transmission lines. For instance, coaxial cables 150 and 160 may be extended and used to transmit signals from the outputs of hybrid circuit 120 to antenna patches 50–80. In this instance, each of the diagonally opposed pairs of patches is preferably disposed on a different side of the printed antenna board 40 (i.e. patches 50 and 70 are on a first side, and patches 60 and 80 are on the other side).

Both the inner conductor and the outer conductor of cable 150 are extended from hybrid circuit 120 to crossover point 95. From the outer edge of patch 50 to crossover point 95, the outer conductor of cable 150 is in electrical contact with patch 50 (e.g. via soldering). The outer conductor of cable 150 is terminated at the extended edge of patch 50 just before crossover point 95, while the inner conductor of cable 150 is extended across crossover point 95 and connects to patch 70. Thus, when the original source signal is propogating through the inner conductor of cable 150, the 180 signal propogates around the inner surface of the outer conductor until both signals reach crossover point 95. At crossover point 95, the original source signal is transmitted via the inner conductor of cable 150 to patch 70, thereby exciting a resonant field. The 180 signal is fed from the inner surface of the outer conductor of cable 150 to edge 51 where it is reflected back into patch 50, thereby exciting another resonant field. Since coaxial cable 150 is an unbalanced transmission line and patches 50 and 70 are fed with approximately equal power and 180 degrees out of phase, an infinite balun may again be thereby defined. Similarly, patches 60 and 80 may be fed via an infinite balun feed means using coaxial cable 160.

Coplanar waveguides may also be used as transmission lines in the present invention. Again it is preferable that patches 50 and 70 be disposed on a first side of PAB 40 and patches 60 and 80 be disposed on the opposing side. A separate coplanar waveguide may be used to replace each of microstrip lines 100 and 110.

The coplanar waveguides may be fabricated by removing a strip of metallization on each of patches 50 and 60 between crossover point 95 and junctions 55 and 65, respectively. A microstrip line may then be disposed on PAB 40 in the space left by the removed strips to connect junctions 55 and 65 to respective patches 70 and 80. Each microstrip line is preferably made narrow enough to leave space between the microstrip line and the patch (50 or 60) on either side of it. The inner conductor of each coaxial cable 150 and 160 is then connected (e.g. via soldering) to the microstrip lines cut into patches 50 and 60, respectively. Also, the outer conductor of each coaxial cable 150 and 160 is connected to its respective patch on either side of the removed strip of metallization.

In operation the original source signal is transmitted via coaxial cable 150 to the microstrip portion of the coplanar waveguide cut into patch 50. As the original source signal propogates through the coplanar waveguide of patch 50, the 180 signal is propogated in the patch 50. When the original source signal and the 180 signal reach crossover point 95, the original source signal is transmitted to patch 70, thereby exciting a resonant field in patch 70, and the 180 signal is reflected back into patch 50, thereby creating another resonant field. The resonant fields created by the original source signal and the 180 signal cause the internal edges 71 and 51 of patches 70 and 50 to radiate as previously described. Since the coplanar waveguide of patch 50 is an unbalanced transmission line, and patches 50 and 70 are fed with approximately equal power and 180 degrees out of phase, an infinite balun may again be thereby defined. Similarly, patches 60 and 80 may be fed via an infinite balun feed means using coaxial cable 160 and a coplanar waveguide cut into patch 60.

Further, it is recognized that the present invention may be provided with impedance matching devices to improve the bandwidth capabilities and voltage to standing wave ratio (VSWR) of antenna 10. For example, tuning stubs may be provided or quarter-wave transformers may be implemented to match the impedance of the transmission lines to the measured impedance at crossover point 95.

As described above, the present invention is able to provide a full phase quadrature (0,90,180, and 270 degrees) balanced feed network for the antenna patches (70,80,50, and 60, respectively) using only a single ninety degree hybrid circuit. Consequently, antenna 10 is able to transceive circularly polarized radiation with a substantial reduction in the number of necessary hybrid feed components. One skilled in the art will recognize that such a reduction in the number of necessary feed components to achieve circular polarization is advantageous in minimizing both the cost and bulk of antenna 10.

Although exemplary embodiments of the present invention have been set forth above, one skilled in the art will recognize that modifications may be made without departing from the spirit and scope of the invention as defined by the appended claims.

What is claimed is:

1. A crossed-slot antenna comprising:

first and second pairs of electrically conductive antenna patch elements disposed to define a crossed slot between opposing internal edges thereof;

a ground means disposed below said first and second pairs of antenna patch elements to define a cavity therebetween;

first feed means for feeding first and second patches of said first pair of antenna patch elements including:

first transmission line means, operatively coupled to each of said first and second patches and positioned above said cavity apart from said ground means, said first transmission line means being disposed in opposing relation to and extending beyond an internal edge of said first patch and across said crossed slot to couple with an internal edge of said second patch to define an infinite balun feed arrangement wherein balanced, 180° out-of-phase feed signals are transmitted to/from said first and second patches of said first pair of antenna patch elements.

2. (Amended) The crossed-slot antenna as recited in claim 1, further comprising:

second feed means for feeding first and second patches of said second pair of antenna patch elements including:

second transmission line means, operatively coupled to each of said first and second patches of the second pair and positioned above said cavity apart from said ground means, said second transmission line means being disposed in opposing relation to and extending beyond an internal edge of said first patch of said second pair of antenna patch elements and across said crossed slot to couple with an internal edge of said second patch of said second pair to define an infinite balun feed arrangement wherein balanced, 180° out-of-phase feed signals are transmitted to/from said first and second patches of said second pair of patch elements.

3. The crossed-slot antenna as recited in claim 2, wherein said first feed means further includes:

a first supply line, interconnected with said first transmission line means, for feeding a first signal to said second patch of said first pair;

and, wherein said second feed means further includes:

a second supply line, interconnected with said second transmission line means, for feeding a second signal to said second patch of said second pair.

4. The crossed-slot antenna as recited in claim 3, wherein:

said first patch of said first pair of antenna patch elements acts as a local ground plane for said first transmission line means and said first patch of said first pair of antenna patch elements is thereby fed a third signal which is 180 degrees out of phase with said first signal; and said first patch of said second pair of antenna patch elements acts as a local ground plane for said second transmission line means and said first patch of said second pair of antenna patch elements is thereby fed a fourth signal which is 180 degrees out of phase with said second signal.

5. The crossed-slot antenna as recited in claim 4, further comprising:

master feed means for supplying said signals to said first and second feed means, including:

phasing means for providing a 90 degree phase difference between said first signal on said first supply line and said second signal on said second supply line, wherein said antenna is thereby able to transceive circularly polarized radiation.

6. The crossed-slot antenna as recited in claim 3, wherein said first and second supply lines comprise inner conductors of first and second coaxial cables, respectively.

7. The crossed-slot antenna as recited in claim 1, wherein the first patch of said first pair and a second patch of said second pair of antenna patch elements are disposed on a first side of a dielectric substrate and the second of said first pair and a first of said second pair of antenna patch elements are disposed on a second and opposing side of said dielectric substrate.

8. The crossed-slot antenna as recited in claim 7, wherein said first transmission line means is disposed on said second side of said dielectric substrate and said first of said first pair of antenna patch elements acts as a local ground plane for said first transmission line means.

9. The crossed-slot antenna as recited in claim 1, further comprising:

broadbanding means interconnected with said first transmission line means for matching impedances of said feed means and said second patch of said first pair of antenna patch elements.

10. The crossed-slot antenna as recited in claim 9, wherein said broadbanding means includes at least one of the following: impedance matching stubs, impedance transformers, and lumped circuit elements.

11. The crossed-slot antenna as recited in claim 1, further comprising:

a foam member bonded between at least one of said antenna patch elements and said ground means, wherein said foam member increases the structural strength and reliability of said antenna.

12. The crossed-slot antenna as recited in claim 1, wherein:

said first transmission line means extends a distance beyond said internal edge of said first patch which is significantly less than a wavelength of radiation to be transceived by said antenna.

13. The crossed-slot antenna as recited in claim 1, further comprising:

a radome, attachable to said ground means, for enclosing said antenna patches.

14. The crossed-slot antenna as recited in claim 1, wherein said first transmission line means comprises at least one of the following: an inner conductor of a coaxial cable, a microstrip line, and a coplanar waveguide.

15. A crossed-slot antenna comprising:

first and second pairs of electrically conductive antenna patch elements disposed to define a crossed slot between opposing internal edges thereof;

a ground means disposed below and spaced from said first and second pairs of antenna patch elements to define a cavity therebetween;

first feed means for feeding first and second patches of said first pair of antenna patch elements including:

first transmission line means, operatively coupled to each of said first and second patches of said first pair and positioned above said cavity apart from said ground means, said first transmission line means being disposed in opposing relation to and extending beyond an internal edge of said first patch of said first pair of antenna patch elements and across said crossed slot to couple with an internal edge of said second patch of said first pair of antenna patch elements to define an infinite balun feed arrangement wherein balanced, 180° out-of-phase feed signals are transmitted to/from said first and second patches of said first pair of patch elements;

a first supply line, interconnected with said first transmission line means, for feeding a first signal to said second patch of said first pair;

second feed means for feeding first and second patches of said second pair of antenna patch elements including:

second transmission line means, operatively coupled to each of said first and second patches of said second pair and positioned above said cavity apart from said ground means, said second transmission line means being disposed in opposing relation to and extending beyond an internal edge of said first patch of said second pair of antenna patch elements and across said crossed slot to couple with an internal edge of said second patch of said second pair of antenna patch elements to define an infinite balun feed arrangement wherein balanced, 180° out-of-phase feed signals are transmitted to/from said first and second patches of said second pair of patch elements;

a second supply line, interconnected with said second transmission line means, for feeding a second signal to said second patch of said second pair;

wherein, said first patch of said first pair of antenna patch elements acts as a local ground plane for said first transmission line means and said first patch of said first pair of antenna patch elements is thereby fed a third signal which is 180 degrees out of phase with said first signal; and said first patch of said second pair of antenna patch elements acts as a local ground plane for said second transmission line means and said first patch of said second pair of antenna patch elements is thereby fed a fourth signal which is 180 degrees out of phase with said second signal; and master feed means for supplying said signals to said first and second feed means, including:

phasing means for providing a 90 degree phase difference between said first signal on said first supply line and said second signal on said second supply line, wherein said antenna is thereby able to transceive circularly polarized radiation.

16. The crossed-slot antenna as recited in claim 15, wherein the first of said first pair and a second of said second pair of antenna patch elements are disposed on a first side of a dielectric substrate and the second of said first pair and a first of said second pair of antenna patch elements are disposed on a second and opposing side of said dielectric substrate.

17. The crossed-slot antenna as recited in claim 15, further comprising:

broadbanding means interconnected with said first transmission line means for matching impedances of said feed means and said second patch of said first pair of antenna patch elements, comprising at least one of the following: impedence matching stubs, impedence transformers, and lumped circuit elements.

18. The crossed-slot antenna as recited in claim 15, further comprising:

a foam member bonded between at least one of said antenna patch elements and said ground means, wherein said foam member increases the structural strength and reliability of said antenna.

19. A crossed-slot antenna comprising:

a ground means;

first and second pairs of electrically conductive antenna patch elements disposed above and spaced from said ground means to define crossed apertures between opposing internal edges of said patches and a cavity between the patch elements and said ground means;

first feed means for feeding said first pair of antenna patch elements including:

first transmission line means, operatively coupled to each of said first and second patches of said first pair and positioned above said cavity apart from said ground means, said first transmission line means being disposed in opposing relation to and extending beyond an internal edge of said first patch of said first pair and across said crossed apertures to couple with an internal edge second patch of said first pair of antenna patch elements to define an infinite balun feed arrangement wherein balanced, 180° out-of-phase feed signals are transmitted to/from said first and second patches of said first pair of patch elements, and wherein said first patch acts as a local ground plane for said first transmission line means.

20. The crossed-slot antenna as recited in claim 19, further comprising:

second feed means for feeding said second pair of antenna patch elements including:

second transmission line means, operatively coupled to each of said first and second patches of said first pair and positioned above said cavity apart from said ground means, said second transmission line means being disposed in opposing relation to and extending beyond an internal edge of said first patch of said second pair and across said crossed apertures to couple with an internal edge of said second patch of said second pair of antenna patch elements to define an infinite balun feed arrangement wherein balanced, 180° out-of-phase feed signals are transmitted to/from said first and second patches of said first pair of patch elements, and wherein said first patch of said second pair of antenna patch elements acts as a local ground plane for said second transmission line means.

21. The crossed-slot antenna as recited in claim 20, further comprising:

master feed means for supplying signals to said first and second feed means, including:

phasing means for providing a 90 degree phase difference between a first signal fed to said first transmission line means and a second signal fed to said second transmission line means, wherein said antenna is thereby able to transceive circularly polarized radiation.

22. The crossed-slot antenna as recited in claim 19, wherein:

said first and second patches of said first pair of antenna patches are fed with first and second signals, respectively, which are 180 degrees out of phase with each other and approximately equal in power.

* * * * *